US012017878B2

(12) United States Patent
Hoffmann et al.

(10) Patent No.: US 12,017,878 B2
(45) Date of Patent: Jun. 25, 2024

(54) METHOD AND DEVICE FOR SUCCESSIVELY WINDING A FILM WEB, AND FILM ROLL

(71) Applicant: Windmöller & Hölscher KG, Lengerich (DE)

(72) Inventors: Frank Hoffmann, Lengerich (DE); Fabian Sundermann, Lengerich (DE)

(73) Assignee: Windmöller & Hölscher KG, Lengerich (DE)

( * ) Notice: Subject to any disclaimer, the term of this patent is extended or adjusted under 35 U.S.C. 154(b) by 440 days.

(21) Appl. No.: 17/289,880

(22) PCT Filed: Nov. 7, 2019

(86) PCT No.: PCT/EP2019/080565
§ 371 (c)(1),
(2) Date: Apr. 29, 2021

(87) PCT Pub. No.: WO2020/099238
PCT Pub. Date: May 22, 2020

(65) Prior Publication Data

US 2021/0403267 A1 Dec. 30, 2021

(30) Foreign Application Priority Data

Nov. 16, 2018 (DE) ..... 10 2018 219 658.3

(51) Int. Cl.
*B65H 19/26* (2006.01)
*B65H 35/00* (2006.01)
*B65H 35/10* (2006.01)

(52) U.S. Cl.
CPC ..... *B65H 19/267* (2013.01); *B65H 35/008* (2013.01); *B65H 35/10* (2013.01);
(Continued)

(58) Field of Classification Search
CPC ..... B65H 19/26; B65H 19/267; B65H 19/28; B65H 35/008; B65H 35/10;
(Continued)

(56) References Cited

U.S. PATENT DOCUMENTS 1,532,753 A * 4/1925 Jones ..... G03B 21/43 242/526
2,272,940 A * 2/1942 Gerard ..... B65H 19/2215 242/532.6

(Continued)

FOREIGN PATENT DOCUMENTS

JP S49-128167 A 12/1974

*Primary Examiner* — Michael R Mansen
*Assistant Examiner* — Henrix Soto
(74) *Attorney, Agent, or Firm* — Peter W. Schroen; Bret E. Field; Bozicevic, Field & Francis LLP

(57) ABSTRACT

The invention relates to a method for successively winding a film web onto a plurality of spools, wherein the film web is wound to form a first spool, and a tube and/or winding shaft for forming a subsequent second spool and the film web are moved closer to one another and/or are brought into contact with one another upstream of the first spool. The film web is cut, and thus an end of the film web is produced, with end is wound onto the first spool, and a new start of the file web is produced, which is wound onto the second tube. In order to cut the film web, the film web is cut partially in the transverse direction, at least one cut edge and at least one uncut region remaining in the transverse direction, the uncut region being subsequently torn off or cut off.

11 Claims, 4 Drawing Sheets

(52) U.S. Cl.
CPC ..... *B65H 2301/5124* (2013.01); *B65H 2301/51514* (2013.01); *B65H 2301/5152* (2013.01); *B65H 2301/515326* (2013.01); *B65H 2515/31* (2013.01)

(58) Field of Classification Search
CPC .. B65H 2301/5124; B65H 2301/51514; B65H 2301/5152; B65H 2301/515326; B65H 2301/41894; B65H 2515/31; B65H 19/29; G03B 21/43
USPC ..... 242/521, 527
See application file for complete search history.

(56) References Cited

U.S. PATENT DOCUMENTS 2,507,144 A * 5/1950 Christman ..... B65H 19/2223 242/531.1
2,776,094 A * 1/1957 Edwards ..... G03B 21/43 53/136.3
2,970,785 A * 2/1961 Eichorn ..... B65H 19/28 242/527
3,912,571 A * 10/1975 Hartbauer ..... B65H 19/29 156/357
4,280,669 A * 7/1981 Leanna ..... B65H 19/26 242/532.7
4,789,109 A * 12/1988 Kyytsonen ..... B65H 19/30 242/527
5,368,253 A 11/1994 Hartley, Jr.
6,270,334 B1 * 8/2001 Cozian ..... B29C 55/165 226/110
6,338,451 B1 * 1/2002 Dorfel ..... B65H 19/286 242/532.3
7,100,657 B2 * 9/2006 Kataoka ..... B65H 18/106 156/565
2003/0087740 A1 * 5/2003 Brinkmann ..... B65H 23/048 493/147
2004/0211859 A1 10/2004 Madrzak et al.

* cited by examiner

METHOD AND DEVICE FOR SUCCESSIVELY WINDING A FILM WEB, AND FILM ROLL

The invention relates to a method for successively winding a film web according to the present disclosure, an associated device according to the present disclosure, and a film roll according to the present disclosure.

In a method for successively winding a film web onto a plurality of spools, the film web is initially wound onto a first spool. When this spool has reached its target format, the film web must be cut, and the new start of the web created in this manner must be wound into a new spool. To this end, either an empty winding tube and/or a winding shaft is provided, the latter in the case of tubeless winding. The winding tube and/or winding shaft are moved closer to one another, while the film web is further wound onto the first spool. Now the film web is caused to be separated, such that the new start of the web is created. Since the film web is cut upstream of the first spool in the transport direction, the remainder of the film web between the cutting device and the first spool is not guided and comes to rest in an undefined manner on the roll. This problem is even greater if the web is under a web tension before it contacts the first spool. If the cutting device performs a sudden cut, the remainder of the film web snaps onto the first spool. This results in a start of a new web that is difficult to use in further processing, which means insufficient winding quality at the end of the spool. In addition, disruptions may occur in the winding means if the film web winds itself around rolls or other components.

It is therefore the problem of the present invention to propose a method, a device, and a film roll which produces an improved quality of the spool, which also includes the web end created by cutting the film.

The above problem is solved according to the invention. The dependent claims indicate potential embodiments of the invention.

According to the present invention, the film web is partially cut in the transverse direction, that is, an incomplete cut is produced in the transverse direction. Thus a cut edge is produced which does not extend completely across the film web, viewed in the transverse direction thereof. However, the incomplete cut applied at this time already defines the end of the film web which is still wound onto the first spool. The start of the new film web, which will be wound onto the new tube or winding shaft, is also defined thereby. "Cutting" means that cuts are made into the film web, for example by using at least one blade.

Furthermore, at least one uncut region remains. This means that despite the definition of the end of the film web and the start of the new film web, these are still attached to one another by a connecting piece. Finally, this uncut region is subsequently torn of or cut off. "Torn off" is to be viewed as a passive process in which the film end is separated by forces acting onto the new end and the new start, whereas "cut off" is to be viewed as an active process in which a cutting device such as a cutting blade is used to cut the uncut region as well. "Subsequent" means a later point in time than the time at which the incomplete cut edge defines the new end and the new start of the film web.

The film web preferably is a plastic film web which die to its elastic property can be under a high tensile stress.

The cutting described preferably takes place downstream of the new tube and/or winding shaft. The terms tube or spool can also mean multiple tubes or spools arranged next to one another, which are wound simultaneously and to which the claimed method is applied simultaneously. Multiple tubes or spools are typically wound simultaneously, such that multiple single webs, so called plies, are formed.

The advantage is that the initially lasting connection of the new end and the new start of the web keeps the produced end of the web under a web tension, allowing it to be wound up further without forming wrinkles or other defects. The subsequent complete split can be performed closer to the first spool or by tearing, which can also be performed closer to the first spool.

It is preferred that less than 50%, particularly less than 30%, of the entire width of the film web initially remain as uncut region. Less than 20% is particularly advantageous, however, since many material compositions require a moderate application of force for tearing off. The invention should of course be understood in that more than 0%, particularly more than 1%, of the overall width of the film web remains as an initially uncut region.

It is an advantage if the uncut region is elongated or stretched after the step of incomplete transverse cutting and the subsequent cutting off or tearing off of the uncut region. Elongation or stretching is caused in that a strongly increased force than that of the typical web tension is applied to the film web. In this manner, the distance of the cut edge of the end of the film web from the new start of the film web can be increased. This shortens the free path of the end of the film web until it reaches the first spool. Preferably, at least a portion of the region then elongated and stretched is wound onto the first spool. This portion then forms a grasping section for subsequent unwinding of the film web from the spool, which an operator or a device can easily grasp to start unwinding. In previous spools, in which the end of the film web had a complete transversal cut, it had always been a problem to find and loosen the end of the web. This problem is particularly severe in thin and/or sticky film webs. Therefore the combination of the present invention with thin and/or sticky film webs, particularly stretch film web, is an advantage.

It is particularly advantageous if the film web is elongated in the uncut region until at least a cut edge substantially rests on the first spool. The previously uncut region is torn or cut only then. A cutting device may be provided for this purpose. A cutting device with which the cutting can be performed may generally, not just with respect to this embodiment, consist of at least two parts, wherein one part is activated at a later time than another part to cause the cut. But likewise, a cutting device may be provided which cuts regions of the film web at time intervals. If the new end of the film web rests on the spool, the useful portion of the film reaches almost to the end of the film web, and this useful portion has been wound by applying a tensile force in this case. Quality loss was thus prevented.

To cut off the initially uncut region, it is advantageous to drive the first spool until the uncut region is completely torn or cut off. This particularly easily causes stretching of the initially uncut region. Special machine components for this purpose can be left out, the existing drive for winding is sufficient. The counterforce which is used to hold the new start of the film web can be provided separately from the embodiment just mentioned and in a different manner. It makes sense to utilize the blocking effect of a cutting device which is used for applying the cut edge. The new start of the film web then remains on the cutting device, while the new end travels on. The uncut region can be elongated or stretched in this manner. Alternative or additional means for applying a counterforce to the new end, such as clamping jaws or other clamping, holding, or braking elements may be provided, which slow down or stop the further transport of the new start of the film web.

It is also an advantage if a fixing force is provided with which the film web is fixed to the second tube and/or winding shaft to provide a counterforce for the tearing-off. This fixing force can increase or replace the counterforce caused by clamping, holding, or braking elements. This fixing force can also be used to fasten the completely cut film web to the new winding tube and/or winding shaft. The fixing force may be an electrostatic force which applies an electric charge to the film web and/or the new winding tube and/or winding shaft, causing attraction. The new winding tube and/or winding shaft can be equipped with an adhesive layer, for example a two-sided adhesive tape or an applied adhesive to which the film web can bond. A pressure roller which is brought into contact for fastening to the new winding tube and/or winding shaft may also be provided.

In a specific embodiment of the invention, at least one blade is brought into contact with the film web for partially cutting the film web, wherein the blade has at least one cutting edge which includes interruptions. Thus at least on cut edge can be applied to the film web, wherein the interruption of the cutting edge causes the uncut region. The interruption can be provided as a recess in the cutting edge of the blade. However, multiple blades arranged in the transverse direction of the transport path of the film web are conceivable as well. It is an advantage in this case if these multiple blades can be moved relative to one another to keep the uncut region variable and adjust it to the needs, for example, the film type. A protective element that can be attached to regions of the cutting edge can make the cutting edge ineffective in that region as well and provide the interruption in this manner. Other actions and/or elements are conceivable, which are also covered by the term "interruptions."

It is an advantage in this context if at least two blades are provided for partially cutting the film web, the cutting edges of which blades are arranged parallel to one another and on different lines. The at least two blades are not only spaced apart in the transverse direction of the transport path of the film web, but instead also in the direction of the transport path. In addition, this spacing can be varied, for example in that the blades can be rotated about an axis which is orthogonal to the film web. Thus the interruption can also easily be eliminated to return to the original state for specific film webs, particularly for especially tear-resistant films, in which the film web can be cut across its entire width without interruption.

In another advantageous embodiment of the invention, at least one beam including electrooptical waves, particularly a laser beam, can be guided transversely to the film web for partially cutting the film web, wherein the beam is at least partially interrupted during such guiding. The beam results in local heating of the film material, which results in its separation. "Transverse" also includes a direction of movement which contains a transverse component with respect to the film web. Such a system can operate completely or at least partially in a non-contact manner, which particularly means that no jam of the web can occur upstream of the cutting blade, which jam could result in undesirable operating conditions.

The problem mentioned above is also solved by a winding device having all features of the present invention, according to which a winding device for successively winding a film web onto multiple spools, having

- a first winding location at which the film web can be wound onto a first spool,
- a second winding location at which a winding tube and/or a winding shaft can be provided,
- a moving device with which the winding tube and/or the winding shaft and the film web can be moved closer to one another or brought into contact with one another upstream of the first spool,
- a cutting device, with which the film web can be cut, wherein an end of the film web can be produced which can be wound onto the first spool and wherein a new start of the film web can be produced which can be wound onto the winding tube and/or winding shaft, is characterized, according to the invention, in that the cutting device includes at least one cutting region in which at least one cut edge which has interruptions in the transverse direction of the film web can be produced in the transverse direction of the film web.

The winding device according to the invention offers the same advantages that have been described in the context of the method according to the invention. The definitions of terms provided in the context of the method according to the invention also apply to the winding device according to the invention.

Since the cut edge has interruptions, an uncut region can be produced at the cut edge. To this end, at least one cutting region of the cutting device can comprise an interruption as well. Embodiments of such a cutting device which comply with the device have already been described in the context of the method according to the invention.

A moving device is a device which causes the first spool to move relative to the new winding tube and/or winding shaft but also causes movement of a machine element with which the film web can be moved. For example, a deflection roller can be placed in the transport path of the film web, allowing the transport path to be changeable.

In another advantageous embodiment of the winding device according to the invention, a control device is provided with which a drive with which the first spool can be rotationally driven can be activated, wherein the control device sends a control signal to the drive for ending the rotational driving after the film web has been torn or cut at the interruption of the cut edge.

Unlike prior art winding devices, the control device thus causes the first spool to be rotationally driven until the film web tears or is cut thereafter to cut through the previously uncut region. The control device can to this end be sent a signal from a sensor device which detects the tearing or cutting. An optical sensor or a motor current monitoring sensor can be provided which detects that the motor no longer has to apply the torque to be applied for stretching or tearing the film web. Apart from the sensor, the control device can also send the control signal for ending the rotational driving after a specific period of time has elapsed.

It is further advantageous if at least one force supply element is provided with which the film web can be fixed to the winding tube and/or winding shaft, such that a counterforce for tearing off can be applied. Such force supply element can for example be an electrostatic charging device, a two-sided adhesive tape, or an applied adhesive. Other details have already been described in the context of the method according to the invention, which apply here as well.

It is also an advantage if the cutting device includes at least one blade for insertion into the film web, wherein the blade includes at least one cutting edge with interruptions. It is particularly advantageous if the interruption is arranged centrally on the blade, such that the initially uncut region of the film web is also arranged centrally if viewed in the transverse direction. In principle, however, a blade without interruptions is conceivable, the cutting edge of which is shorter than the width of the film web, such that a respective uncut region is formed on one edge or on both edges of the film web.

The problem mentioned above is further solved by a film roll having a film web wound onto it, wherein the start of the film web is arranged radially inside and the end of the film web is arranged radially outside, and which is characterized, according to the invention, in that the end of the film web includes at least one region having at least one cut edge and at least one region projecting beyond the cut edge in the winding direction. In other words, the rear end, viewed in the running direction of the film web, is not smoothly cut off in the transverse direction but has at least one region which projects beyond the cut edge. The entire cut edge thus has an unsteady contour and may be somewhat frayed. The winding direction of the film roll is opposed to the transport direction of the film web in the winding device, that is, it runs from inside to outside. It is an advantage in this context that the film roll thus comprises a grasping section with which the film end can easily be released from the outer periphery of the film roll, either manually or inside a machine.

It is advantageous if the region projecting beyond the cut edge has an elongation, which particularly is greater than the elongation of the film web of the rest of the film roll. The elongated region is typically characterized in other material and geometrical properties, particularly in a smaller film thickness and different stretchability compared to the film web of the rest of the film roll.

It is further advantageous if the region projecting beyond the cut edge includes a tear-off edge, which particularly has a random edge contour. Such an edge contour is thus not reproducible.

Other advantages, features, and details of the invention can be derived from the following description which explains various exemplary embodiments in detail with reference to the figures. The features mentioned in the claims and in the description can be essential to the invention, either alone or in any combination of features mentioned. Within the scope of the entire disclosure, features and details described in the context of the method according to the invention and/or with the film roll according to the invention, also apply in the context of the winding device according to the invention and/or with the film roll according to the invention and vice versa, such that these are or can be referenced alternately with respect to each aspect of the invention regarding the disclosure. Wherein:

Figure 1:
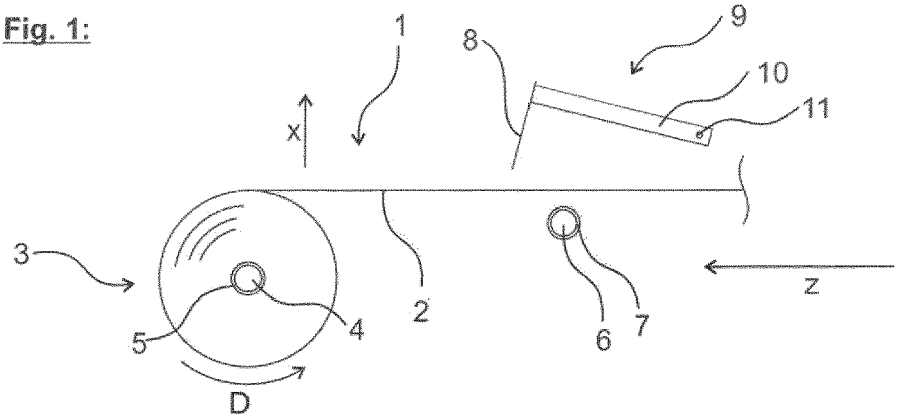
FIG. 1 shows a side view of a schematic diagram of a winding device according to the invention

FIG. 1 shows a schematic diagram of a winding device 1, showing just the components that are essential to the invention. First, the film web 2 is visible, which is conveyed along a transport path in the transport direction z. It is not shown that the film web can be transported via other rollers or rolls, such that the transport path is not necessarily linear. The film web 2 is wound onto a first spool 3 which rotates about a winding shaft 4 of the winding device 1 in the direction of rotation D to wind up the film web 2. The winding shaft 4 can carry a winding tube 5, which is part of the spool 3 in as much as it is pushed from the winding shaft 4 together with the wound-up film web after the spool 3 is completed. Alternatively, tubeless winding is possible, in which the film web is wound directly onto the winding shaft 4.

The winding shaft 4 is directly or indirectly connected to the machine frame of the winding device. The winding shaft 4 is often rotatably arranged on a component which can be moved relative to the machine frame. Such a component may for example be a carriage or a rotary plate, particularly in a so-called reversing winder. The new winding shaft 6, the function of which is described in more detail below, can be inserted into the carriage before or after the spool change at the position of the first winding shaft 4 or—in the case of a rotary plate—be mounted in the rotating disc as well. More winding shafts are conceivable, which may particularly be arranged in a rotary plate. It is also not shown that the winding shafts can be released from the rotary plates at least on one of their ends, while the other end preferably is still mounted in the rotary plate. Thus the finished spool, or the finished spools in the case of multi-spool winding, can easily be pulled from the respective winding shaft.

Figure 8:
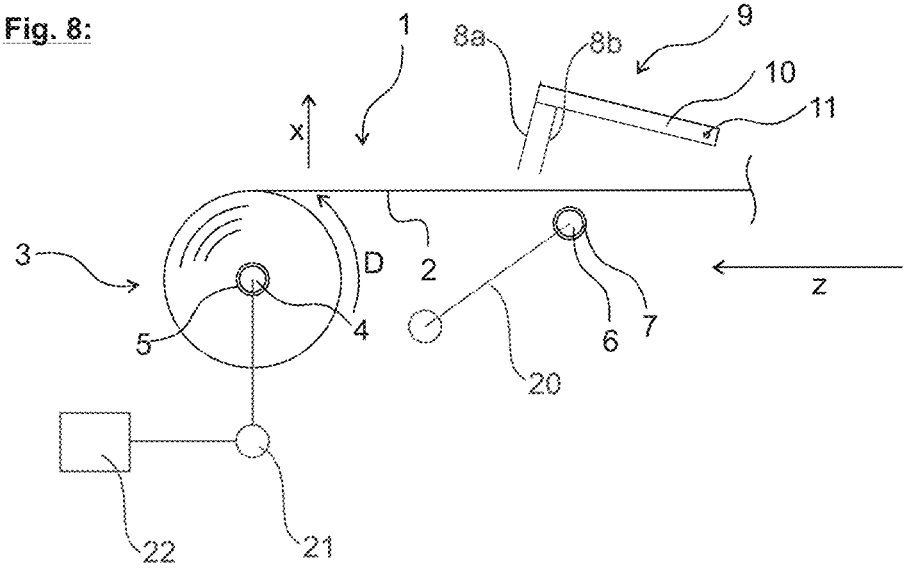
FIG. 8 is like FIG. 1, but with at least two blades, a moving device, a control device, and a drive shown.

The new winding shaft 6 already carries a winding tube 7 and is already near the transport path of the film web 2. A cutting device which includes a blade 8 in the exemplary embodiment shown, is also arranged near the transport path of the film web 2 and in an inactive position in which it is kept on standby for cutting the film web 2. The blade 8 is arranged on a blade carrier 9. To move the blade relative to the film web 2 for performing the cut, the blade carrier preferably includes at least one lever arm 10 which can be rotated about an axis of rotation 11, such that the blade can be inserted in a swiveling manner in an active position into the transport path of the film web 2 to provide it with cuts. The lever arm 10 can for example be mounted via the axis of rotation 11 on the machine frame or on the component which moves the winding shafts relative to the machine frame, such as a rotary plate or carriage. FIG. 8 presents an alternate version of FIG. 1 depicting blades 8*a* and 8*b*, moving device 20, control device 22 and drive 21.

Figure 2:
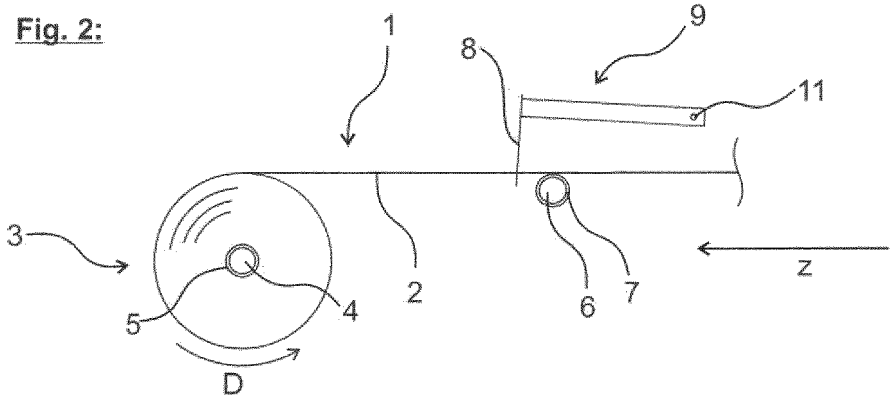
FIG. 2 is like FIG. 1, but with a new winding shaft provided

FIG. 2 now shows the same winding device as FIG. 1, but with a new winding shaft 6 moved further towards the film web 2 and the cutting device just inserted into the transport path of the film web 2. The new winding shaft 6 is preferably arranged upstream of the blade 8, that is, against the transport direction z.

Figure 3:
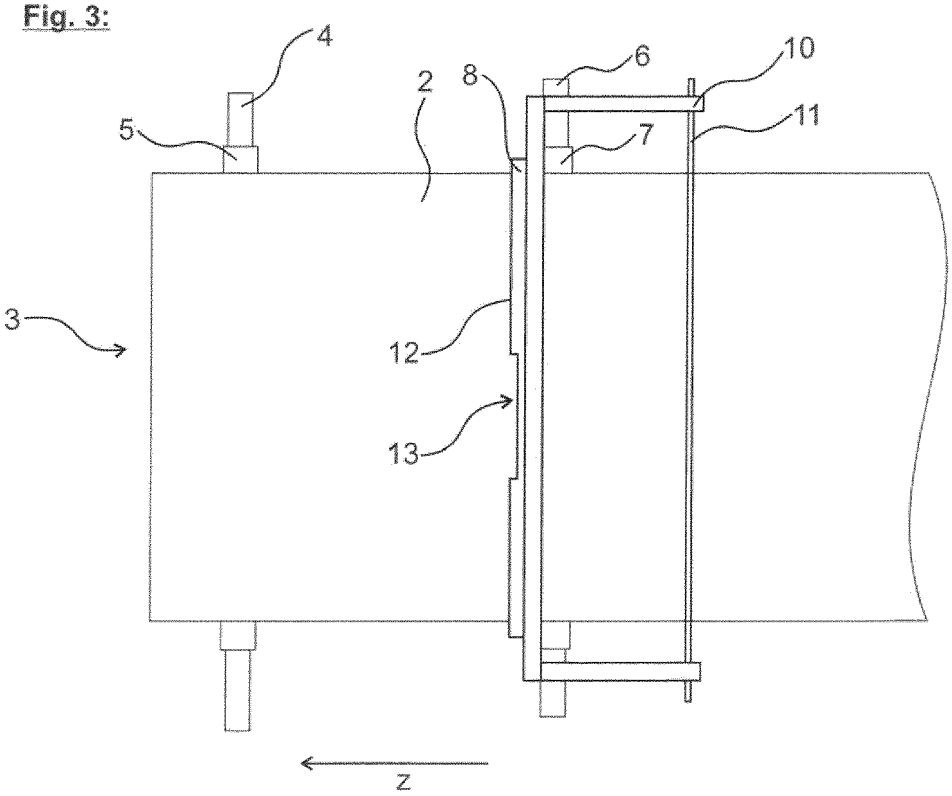
FIG. 3 is like FIG. 2, but a plan view thereof

FIG. 3 shows the same situation as FIG. 2 in a plan view. It is particularly well visible here that the cutting device, in the exemplary embodiment shown the blade 8, comprises a cutting edge 12 which has an interruption 13. The effect of this interrupted cutting edge becomes apparent in the FIGS. 4 to 8.

Figure 4:
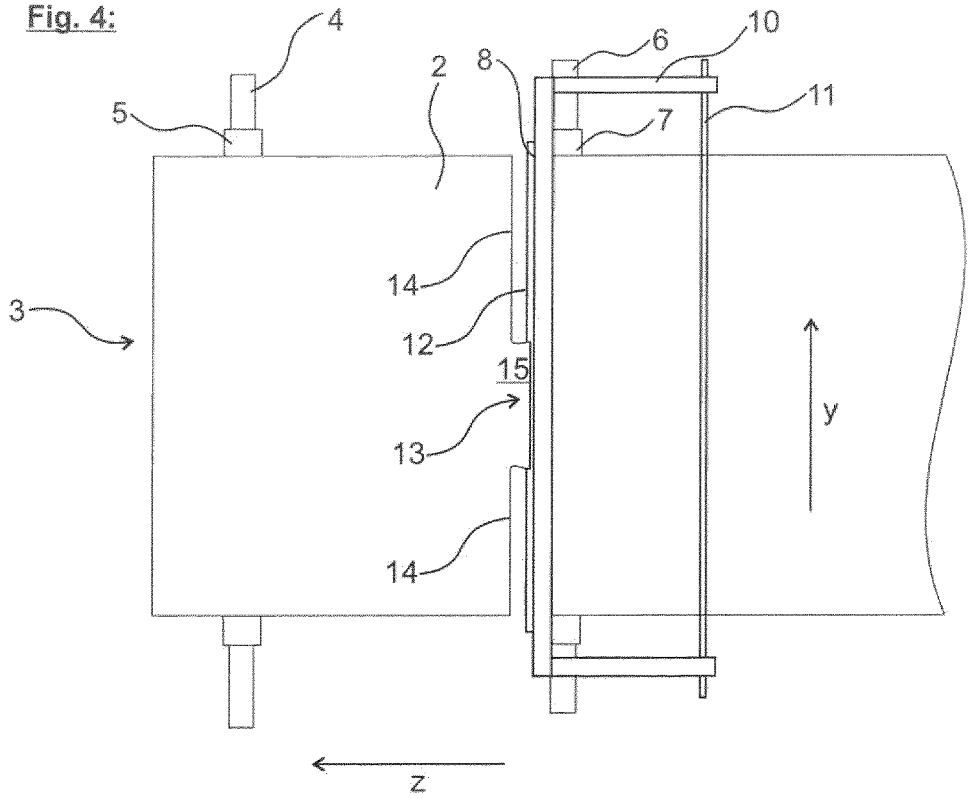
FIG. 4 is like FIG. 3, but with the film web transported further onto the first spool.
Figure 5:
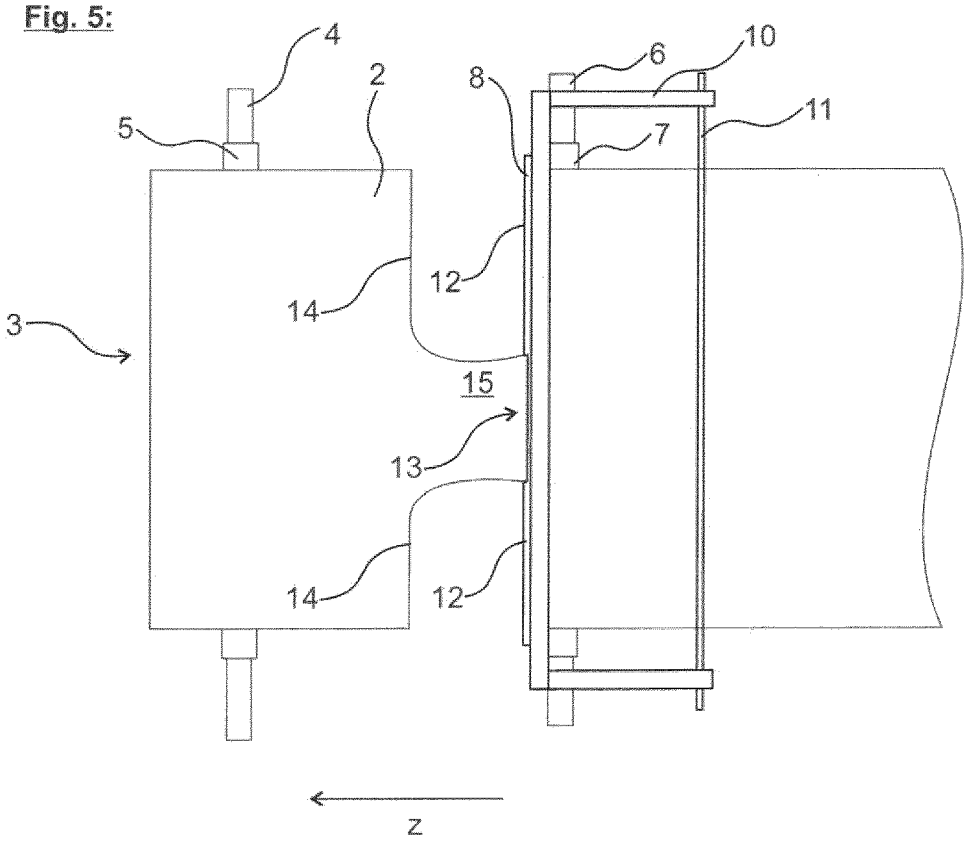
FIG. 5 shows a situation in which an uncut region is now elongated due to the continued rotary movement of a spool and the counter rotation of the new start of the film web against the blade.

FIG. 4 shows the same view as FIG. 3, but with the film web 2 transported further onto the first spool 3. Due to the interruption 13 of the cutting edge 12 of the blade 8, cut edges 14 were produced since the cutting edge 12 cut the film web but the film web was not changed in the region of the interruption 13, wherein the cut edges in the exemplary embodiment shown extend approximately in a transverse direction y to the transport direction z. The cut edges 14 now form the new end of the film web 2. The respective counterparts of the cut edges 14 are in FIG. 4 hidden behind the cutting blade 8 and form the new start of the film web 2, which is to be wound onto the new spool. An uncut region 15 of the film web 2 remained in the region of the interruption 13 of the cutting edge 12, which uncut region is now elongated due to the continued rotary movement of the spool (force action) and the counter rotation of the new start of the film web 2 against the blade 8 (counterforce). This situation is visible in FIG. 5.

Figure 6:
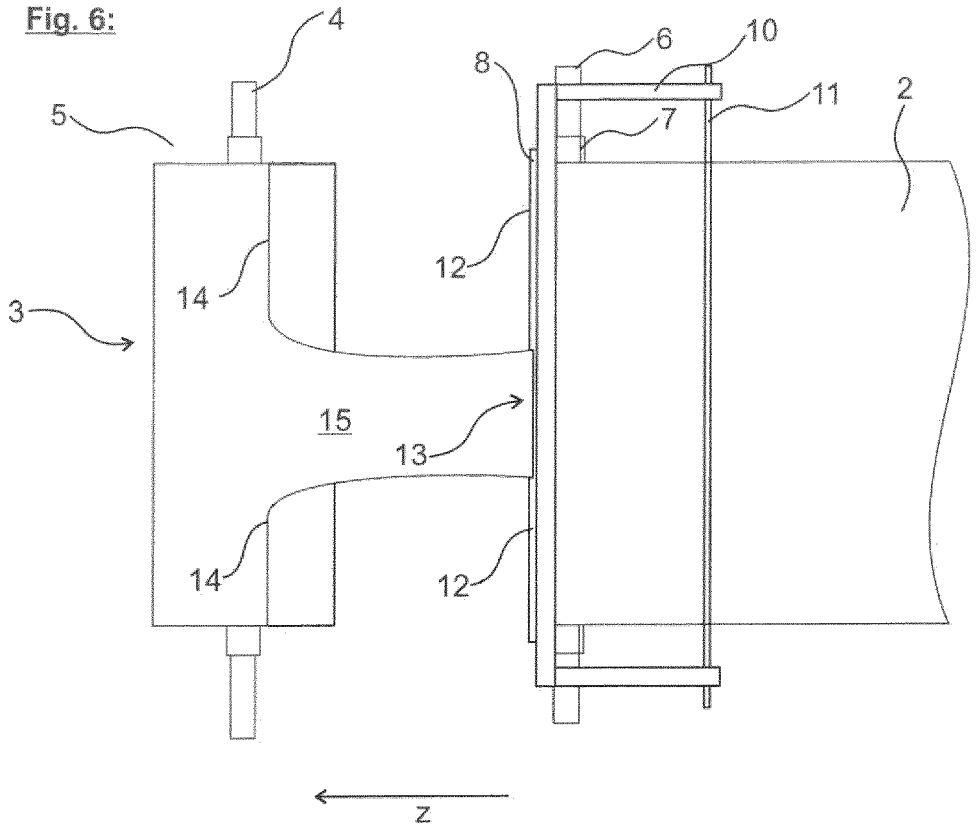
FIG. 6 shows an embodiment in which an uncut region is further elongated until the cut edges come to rest or at least almost rest on the layer of the wound-up film web lying underneath.
Figure 7:
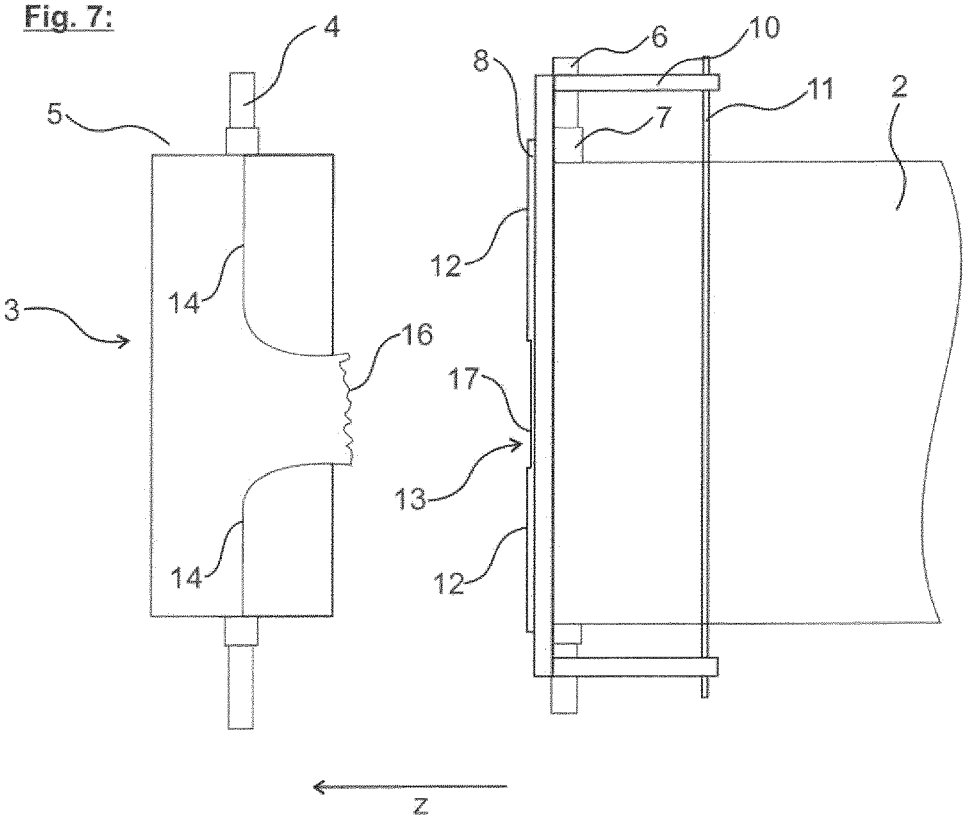
FIG. 7 shows the tearing off of an uncut region.

FIG. 6 shows a particularly preferred exemplary embodiment of the invention in which the uncut region 15 is further elongated until the cut edges 14 come to rest or at least almost rest on the layer of the wound-up film web lying underneath. In this final step, the uncut region 15 is cut. It is shown that a drive force is further applied to the spool 3 until the uncut region tears off, which is shown in FIG. 7. Another cut edge 16 is produced, which is set back in relation to the cut edges 14, that is, projects beyond the cut edges 14 against the transport direction z. The cut edge 16 has a random contour, which typically is not reproducible.

A respectively equipped cutting device can also actively perform the cutting. Another blade may be provided for this purpose. But it is also possible that the interruption 13 of the cutting edge 12 only is a section 17 of the cutting edge set back in an orthogonal direction x (see FIG. 1) of the film web 2. The blade 8 can then be moved into the transport path of the film web 2 for producing the cut edges 14 that the cutting edge 12 produces the cut edges, but the set back section 17 of the cutting edge has not yet come into contact with the uncut region 15. If a complete cut-off is to be achieved at a later time, the blade 8 can be moved further in a subsequent step, such that the set back section 17 gets into the transport path of the film web as well and cuts the same.

| List of reference numerals | |
|---|---|
| 1 | winding device |
| 2 | film web |
| 3 | spool |
| 4 | winding shaft |
| 5 | winding tube |
| 6 | winding shaft |
| 7 | winding tube |
| 8 | blade |
| 9 | blade carrier |
| 10 | lever arm |
| 11 | axis of rotation |
| 12 | cutting edge |
| 13 | interruption |
| 14 | cut edge |
| 15 | uncut region |
| 16 | cut edge |
| 17 | set back section |
| D | direction of rotation |
| x | orthogonal direction |
| y | transverse direction |
| z | direction of transport |

The invention claimed is:

1. A method for successively winding a film web onto a plurality of spools, wherein the film web is wound into a first spool, a tube and/or winding shaft for forming a subsequent second spool and the film web are moved closer to one another and/or brought into contact upstream of the first spool, a cutting of the film web is caused, wherein an end of the film web is produced which is wound onto the first spool and wherein a new start of the film web is produced which is wound onto the second spool, wherein for cutting the film web, the film web is partially cut in the transverse direction, leaving at least one cut edge and at least one initially uncut region in the transverse direction, wherein the at least one initially uncut region is subsequently torn off or cut off, after the film web has been partially severed and before the at least one initially uncut region is torn off or separated, the film web is stretched in the at least one initially uncut region, and the at least one initially uncut and stretched region is at least partially placed on the first spool, the at least one initially uncut and stretched region forming a grasping section.

2. The method according to claim 1, wherein the first spool is driven until the at least one initially uncut region is completely torn off or cut off.

3. The method according to claim 1, wherein at least one blade is brought into contact with the film web for partially cutting the film web, wherein the at least one blade has at least one cutting edge which includes interruptions.

4. The method according to claim 3, wherein at least two blades are provided for partially cutting the film web, wherein the cutting edges of the at least two blades are arranged parallel to one another and on different lines.

5. A winding device for successively winding a film web onto a plurality of spools, having a first winding location at which the film web can be wound onto a first spool, a second winding location at which a winding tube and/or a winding shaft can be provided, a moving device with which the winding tube and/or the winding shaft and the film web can be moved closer to one another or brought into contact with one another upstream of the first spool, a cutting device, with which the film web can be cut, leaving at least one cut edge and at least one initially uncut region, wherein a stretched region of the film web can be produced from the at least one initially uncut region, the at least one initially uncut and stretched region forming a grasping section which can be wound onto the first spool and wherein a new start of the film web can be produced which can be wound onto the winding tube and/or winding shaft, wherein the cutting device includes at least one cutting region in the at least one cut edge which has interruptions in the transverse direction of the film web can be produced in the transverse direction of the film web.

6. The winding device according to claim 5, wherein a control device is provided with which a drive with which the first spool can be rotationally driven can be activated, wherein the control device sends a control signal to the drive for ending the rotational driving after the film web has been torn or cut at the interruption of the cut edge.

7. The winding device according to claim 5,
wherein
the cutting device includes at least one blade for insertion into the film web, wherein the at least one blade includes at least one cutting edge with interruptions.

8. The winding device according to claim 5,
wherein
the cutting device includes at least two blades for insertion into the film web, the cutting edges of which are preferably arranged parallel to one another and on different lines.

9. A film roll with a wound-up film web, wherein the start of the film web is arranged radially inside and the end of the film web is arranged radially outside,
wherein
the end of the film web includes at least one region with at least one cut edge and at least one stretched region which projects beyond the at least one cut edge in the winding direction, the stretched region forming a grasping section.

10. The film roll according to claim 9,
wherein
the at least one stretched region projecting beyond the at least one cut edge has an elongation.

11. The film roll according to claim 9,
wherein the at least one stretched region projecting beyond the at least one cut edge includes a tear-off edge, which has a random edge contour.

* * * * *